US005574246A

United States Patent [19]

Meyers et al.

[11] Patent Number: 5,574,246

[45] Date of Patent: Nov. 12, 1996

[54] UNDERWATER VEHICLE WITH IMPROVED JET PUMP PROPULSION CONFIGURATION

[75] Inventors: Scott C. Meyers, Fountain Hills; David M. Mathis, Phoenix; Eugene A. Zanelli, Scottsdale, all of Ariz.

[73] Assignee: AlliedSignal Inc., Morris Township, N.J.

[21] Appl. No.: 426,331

[22] Filed: Apr. 21, 1995

[51] Int. Cl.[6] ..... F42B 19/12; B63G 8/08; B63H 11/00

[52] U.S. Cl. ..... 114/20.2; 114/337; 114/338; 440/38

[58] Field of Search ..... 114/20.1, 20.2, 114/337, 338; 440/38, 6

[56] References Cited

U.S. PATENT DOCUMENTS

| | | | |
|---|---|---|---|
| 1,498,919 | 6/1924 | Jensen . | |
| 2,351,750 | 6/1944 | Fawkes | 114/20.2 |
| 2,969,759 | 1/1961 | Giles | 114/20.1 |
| 3,112,610 | 12/1963 | Jerger . | |
| 3,194,201 | 7/1965 | Lang | 114/20.1 |
| 3,205,846 | 9/1965 | Lang | 114/20.1 |
| 3,575,127 | 4/1971 | Wislicenus | 114/20.2 |
| 4,346,662 | 8/1982 | Rogers | 114/20.1 |
| 4,395,965 | 8/1983 | Lang | 114/20.1 |
| 4,427,338 | 1/1984 | Furst | 415/210 |
| 4,648,322 | 3/1987 | Heitz et al. | 114/20.1 |
| 4,929,200 | 5/1990 | Guezou et al. | 440/38 |
| 4,991,530 | 2/1991 | Rathsam | 114/20.1 |
| 5,045,004 | 9/1991 | Kim | 114/20.2 |
| 5,266,009 | 11/1993 | Tasaki et al. | 440/38 |
| 5,438,947 | 8/1995 | Tam | 114/337 |
| 5,445,105 | 8/1995 | Chen et al. | 114/338 |
| 5,480,330 | 1/1996 | Brown | 440/38 |

*Primary Examiner*—Michael J. Carone
*Assistant Examiner*—Theresa M. Wesson
*Attorney, Agent, or Firm*—Jerry J. Holden; John R. Rafter

[57] ABSTRACT

An underwater vehicle such as a torpedo has a jet pump propulsion system. A high speed pump is located inside a rigid cylindrical housing of the torpedo near an end thereof. A water inlet communicates with the pump as does a water outlet provided at the aft end of the rigid housing via a water passage. A high speed electrical motor, on the order of 10,000 rpm, is provided inside an inner cylindrical housing disposed within the outer cylindrical housing. The electric motor is provided aft of the pump and the electric motor shaft is directly coupled to the pump rotor. Only one bearing and one water seal is provided between the electric motor and pump rotor. A water exit passage is provided between the inner cylindrical housing containing the high speed motor and the rigid outer cylindrical housing. Water passing through the exit passage cools the electric motor by dissipating heat therefrom. Motor control electronics can be provided immediately aft of the high speed electric motor, in which case water passing through the exit passage also serves to cool the motor electronics by dissipating heat therefrom.

5 Claims, 2 Drawing Sheets

UNDERWATER VEHICLE WITH IMPROVED JET PUMP PROPULSION CONFIGURATION

FIELD OF THE INVENTION

This invention relates to an underwater vehicle such as a torpedo or submarine having a jet pump propulsion system of an improved and efficient configuration.

BACKGROUND OF THE INVENTION

Underwater vehicles such as torpedoes have conventionally had open propeller propulsion systems. Such open propeller propulsion systems are, however, subject to a number of disadvantages. High noise generation and cavitation are, of course, some of the disadvantages. Other disadvantages include the possibilities of propeller fouling when the torpedo is operated in areas where there is debris in the water. Still other disadvantages relate to the sometime necessity to trail control wires or hydrophones or the like behind the torpedo as it traverses through the water, which raises possibilities of fouling the control wires or hydrophone arrays in the propeller. The prior art has focused on very elaborate constructions for housing and trailing the hydrophone arrays behind a propeller construction, as well as complex arrangements for routing control cables and the like from a torpedo housing to a towed array of sensors or control wires extending behind a propeller.

It is known to provide some improvement, particularly as far as cavitation and noise, by providing a power source for torpedoes and the like which is a propeller enclosed in a shroud or housing. One prior art patent which shows such a shrouded construction is the Jerger U.S. Pat. No. 3,112,610. While a shrouded propeller solves some of the problems associated with the conventional open propeller propulsion design, it does not obviate them all.

It is also known to provide a torpedo or other underwater vehicle with what is known as a jet pump propulsion. Basically, a motor driven pump is provided inside the torpedo or other underwater vehicle with water being taken in, pressurized, and pumped out near the aft end of the torpedo or other underwater vehicle to form a jet pump propulsion unit for the torpedo or other vehicle. One such jet pump arrangement is shown in Wislicenus U.S. Pat. No. 3,575,127. Wislicenus basically shows a torpedo construction having a jet pump in which the jet pump appears to be mounted at the extreme aft end of the torpedo, with a motor provided which is only diagrammatically shown and described as located in a substantially forward direction from the pump. It appears that the primary purpose of the arrangement in Wislicenus is to introduce substantial amounts of radial and transverse direction components into the water flow through the pump arrangement in order to reduce the flow velocity over the impeller blades and thereby reduce the level of radiated noise.

Many general design considerations have to be kept in mind in connection with design of a torpedo or similar underwater vehicle. For example, the separation between the center of gravity and the center of pressure for the torpedo or other underwater vehicle should be small, such that the travel direction and control over that direction can be achieved with small control surfaces or fins. That is, if the center of gravity moves substantially forward with respect to the center of pressure then the control fins or the control surfaces have to be very large to control the travel direction of the torpedo or other underwater vehicle. A similar design consideration relates to the weight of the propulsion hardware for the torpedo or other underwater vehicle. Propulsion hardware is generally typically heavier than electronics and the like which are carded in a torpedo, and the propulsion hardware is generally carded towards the aft end of the torpedo. This makes the torpedo or other vehicle heavier in back, and if the weight is not carefully controlled and minimized, it can affect the characteristics of the vehicle. For example, if the vehicle is not neutrally buoyant but has an angle of attack with regard to the vector of travel through the water, then drag is induced substantially cutting down on the efficiency of the torpedo or other vehicle. It is therefore quite important to minimize to the extent possible the weight of the propulsion hardware for a torpedo or like underwater vehicle.

OBJECTS AND SUMMARY OF THE INVENTION

It is an object of the present invention to provide a torpedo or other underwater vehicle having a jet pump propulsion system designed to be a low weight and high efficiency propulsion system.

It is a more specific object of this invention to provide an underwater vehicle with jet pump propulsion in which a high speed electric motor is close coupled to a pump for minimizing size and weight of the propulsion system.

It is another object of this invention to provide an underwater vehicle with jet pump propulsion in which an electric motor is situated aft of a pump with water flow from the pump passed through a passage adjacent a housing for the motor for achieving cooling of the motor.

It is another object of this invention to provide such an underwater vehicle in which motor control electronics are also situated aft of the electric motor and adjacent the water flow passage such that water being expelled to propel the vehicle also serves to cool the motor control electronics.

Briefly, in accordance with one embodiment of the invention, an underwater vehicle such as a torpedo is provided with a jet pump propulsion system. The underwater vehicle has an elongated rigid cylindrical housing having a forward end and an aft end, with a pump located inside the housing near the aft end. The pump has a rotatable rotor and a fixed stator. At least one water inlet passage is formed in the rigid housing forward of the pump for communicating water from the mass of water surrounding the underwater vehicle to the pump rotor. A generally cylindrical inner housing contains a high speed electric motor located immediately adjacent and aft of the pump, with the motor having a shaft to which the pump rotor is fixed. At least one water exit passage communicates with the pump stator and runs longitudinally along the inner housing past the electric motor with water exiting through the rigid cylindrical housing adjacent the aft end for propelling the vehicle.

Other substantial objects and advantages of the invention will appear from the following detailed description taken in conjunction with the accompanying drawings.

DETAILED DESCRIPTION

Figure 1:
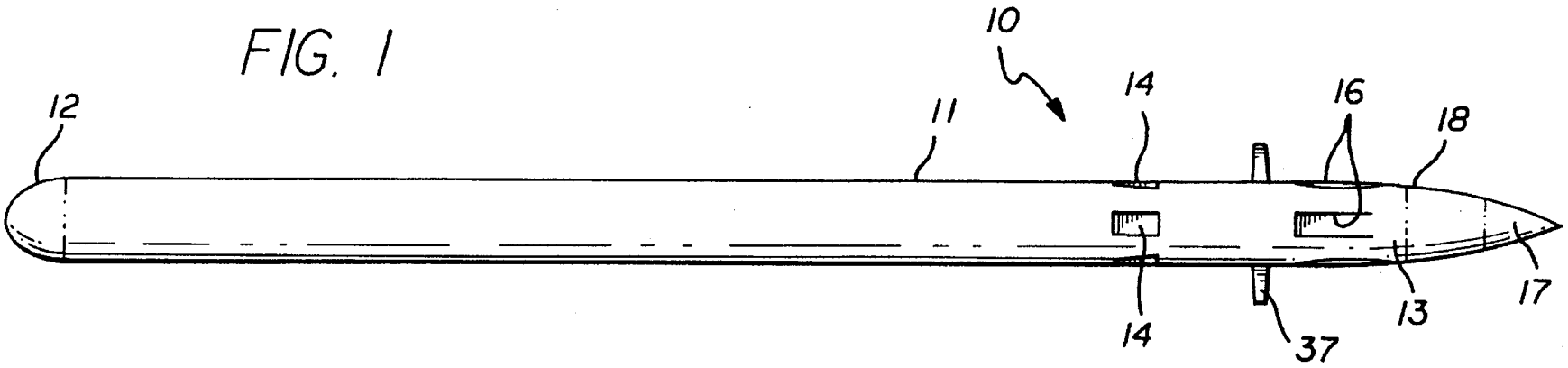
FIG. 1 is a side elevation of a torpedo in accordance with one embodiment of the invention showing the overall external configuration.

Turning now generally to FIG. 1, there is shown a side elevation of the exterior of a torpedo constructed in accordance with one embodiment of the invention. The torpedo, generally indicated by reference numeral 10, has a longitudinally extending rigid cylindrical housing 11. In accordance with one embodiment of the invention, the cylindrical housing 11 is approximately 8' long and approximately 6" in diameter. The torpedo 10 has a forward end 12 and an aft end 13. The cylindrical housing of the torpedo 10 has water inlets indicated by reference numeral 14 and can have several of these spaced around the periphery of the housing. Similarly, a number of water outlet passages 16 are provided adjacent the aft end of the torpedo and are indicated by reference numeral 16. In FIG. 1, the torpedo is shown with control fins 37 deployed, i.e. unfolded from the body of the torpedo as after launching.

In accordance with a specific embodiment of the invention, and as shown in FIG. 1, the torpedo 10 has a flexible bladder 17 which, when the torpedo is in a stored condition, can be in a folded condition inside a compartment adjacent the blunt end 18 of the torpedo. After launch, the bladder 17 is inflated with ambient water under pressure such that it unfolds and extends as shown in FIG. 1, to form a streamlined aft end for the torpedo. The details of flexible bladder 17 and the manner in which it is stored are disclosed in copending application Ser. No. 08/413,064, filed Mar. 29, 1995, now U.S. Pat. No. 5,522,337 and the disclosure of that copending application is hereby incorporated by reference.

Figure 4:
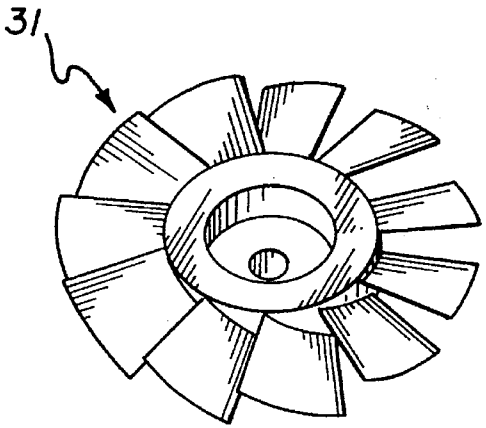
FIG. 4 is perspective view of the pump rotor of the pump shown in FIG. 2.

In accordance with the embodiment of the invention shown in FIG. 1, the forward portion of the torpedo contains power sources such as batteries, together with mission and guidance electronics. The specifics of the mission and guidance electronics, as well as the batteries and the like, are not shown, and the details of these are not any particular part of the present invention. The inventive features of the present invention focus on the pump and motor arrangement provided near the aft end of the torpedo, and attention is directed to FIGS. 2 through 4 for the specifics of these components and their interrelationship.

Figure 2:
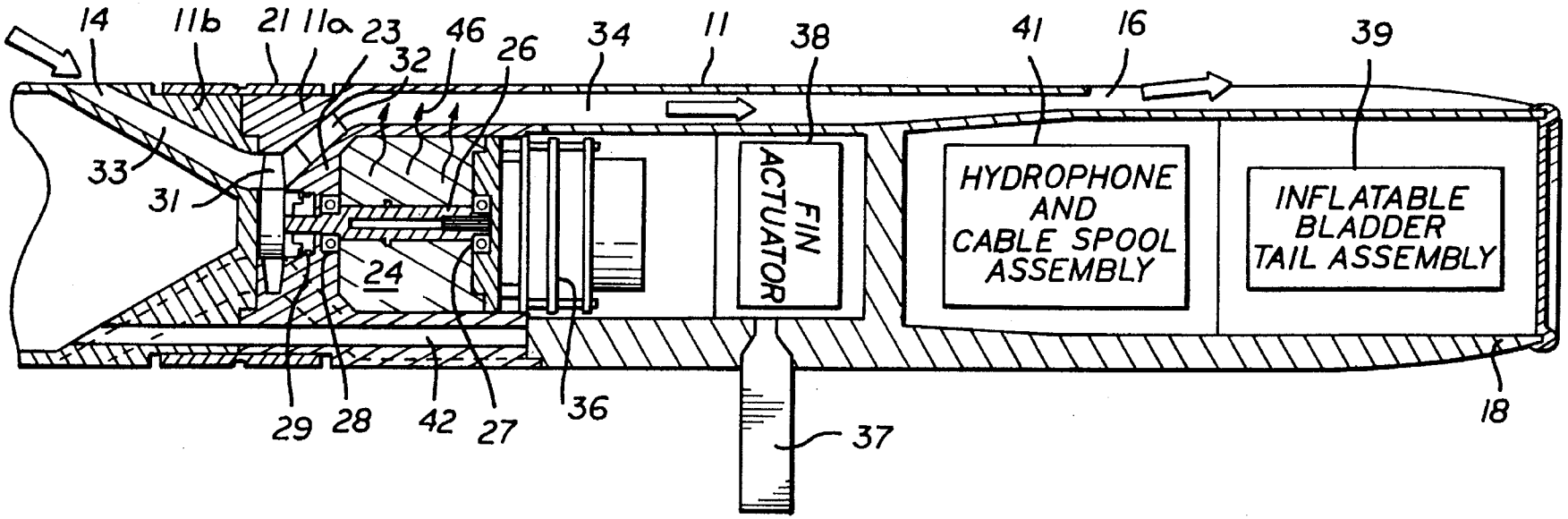
FIG. 2 is a side elevation partially in section and partially in diagrammatic form of the aft portion of the torpedo shown in FIG. 1.

FIG. 2 shows a view, partially in cross-section and partially diagrammatic, of the aft section of the torpedo 10. As can be seen in FIG. 2, the rigid cylindrical housing 11 is actually made up of various sections, with two sections 11a and 11b being shown in FIG. 2. The sections 11a and 11b are held together through the use of turn buckle arrangements shown generally by reference numeral 21.

An inner cylindrical housing 23 (FIG. 2, FIG. 4) is disposed within the rigid outer housing 11 and contains a high speed electrical motor indicated by reference numeral 24. The motor includes a shaft 26 supported at one end by beating 27 and supported at the opposite end by bearing 28. The motor shaft 26 extends through a sea water seal 29 and a pump rotor 31 (FIG. 2, FIG. 3) is attached to the motor shaft. Pump stator vanes are shown by reference numeral 32.

A water inlet 14 is shown in FIG. 2 and can be one of several water inlets spaced around the periphery of the cylindrical rigid housing 11. The water inlet 14 communicates via a water passage 33 with the pump rotor vanes 31. The pump stator vanes 32 communicate via a water passage 34 passing between the outer rigid housing 11 and the relatively thin walled inner housing 23 with a water outlet 16. The water outlet 16 as shown in FIG. 2 can be one of a plurality of such water outlets provided around the periphery of the rigid cylindrical housing 11.

FIG. 2 shows a motor electronics assembly 36 provided adjacent to the motor 24 and extending across the inner cylindrical housing 23.

Shown in diagrammatic form in FIG. 2 is a control fin 37 shown in deployed condition actuated by a suitable fin actuator 38. In accordance with a specific embodiment, the control fin 37 is folded within housing 11 until the torpedo is deployed, whereupon it is folded out to serve as a control surface for the torpedo. Also shown in diagrammatic form in FIG. 2 are an inflatable bladder tail assembly 39 and a hydrophone and cable spool assembly 41 which can be provided in compartments adjacent the aft end of the rigid cylindrical housing 11. The inflatable bladder tail assembly 39 and hydrophone and cable spool assembly 41 are not essential parts of the present invention. Rather, they are shown in FIG. 2 as incorporated in an exemplary embodiment of a torpedo constructed in accordance with the principles of this invention, as it relates to the close coupled motor and pump assembly, and provision of cooling arrangements for cooling the motor as well as any motor control electronics.

Figure 3:
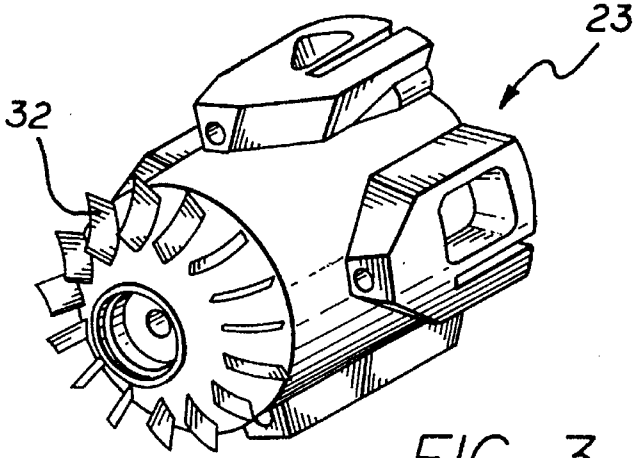
FIG. 3 is a perspective view of the inner motor housing in FIG. 2 showing the structure defining the water exit flow passages and stator vanes formed on the motor housing.

FIG. 3 shows a perspective view of the inner housing 23, showing the stator vanes 32 formed on the outside. As shown in FIG. 2, pass through tubes 42 are provided for routing cabling which might be required from portions of the torpedo forward of the pump and motor assembly to the rear thereof, i.e., as to the motor electronics package 36, for example. Details of control cabling and the like are not shown in FIG. 2 for the sake of clarity.

The pump 24 is a high speed pump in accordance with the principles of this invention. Typical jet pump motors for vehicles of this diameter in the prior art have had a speed of 2,000 to 3,000 rpm. Such slow speed motors have necessitated fairly large size motors with large shafts, adding size and weight to the propulsion units. In accordance with the preferred embodiment of this invention, the motor 24 has a speed of 10,000 rpm. In accordance with the principles of this invention, a motor speed of at least 6,000 rpm is required in order to achieve lower torque loads on the motor shaft for a given amount of motor power in order to thus minimize shaft size and weight. For larger diameter vehicles, the jet pump motor speeds will be proportionately lower.

As shown in FIG. 2, a very important aspect of the present invention is the close coupling or short distance between the pump comprising rotor 31 and stator 32. That is, the motor and pump are coupled directly adjacent each other, with there only being one bearing and one water seal required between the two. This minimizes weight and complexity and, together with the high speed nature of the motor 24, leads to a very efficient design involving a small size and small weight propulsion unit.

The water entering passageway 33 to inlet 14 is pumped by the pump comprising the rotor 31 and stator 32 along the exit passage 34 under pressure. The exiting of the water through outlet 16 at the aft end of the rigid cylindrical housing 11 propels the torpedo forward. Because the housing 23 has a thin wall which, cooperating with the outer cylindrical housing 11 defines the water exit passageway 34, water is continually passing through the passageway 34 while the torpedo is traveling through the water. Since the motor 24 provided in the housing 23 is immediately adjacent the water exit passageway 34, the water passing through this passageway serves as a cooling means for the motor 24, dissipating heat build up in the motor as shown by the diagrammatic arrows 46 shown in FIG. 2. In a like manner, the motor electronics assembly 36 is also disposed adjacent to the thin wall of the housing 23, and the water passing through the water exit passage 34 also serves to dissipate heat generated in the motor electronics assembly 36. If desired, and assuming the motor electronics unit 36 includes solid state controls for the DC brushless motor 24, any power transistors and the like can even be mounted to the thin wall of housing 23 for achieving even more efficient heat dissipation.

While the invention and its principle elements have been described herein by reference to a particular preferred embodiment, it should be understood that the invention is not limited to the particular embodiment disclosed, but that it is intended by the appended claims to define the true spirit and scope of the invention.

What is claimed is:

1. An underwater vehicle having a jet pump propulsion system comprising:

an elongated rigid cylindrical housing having a forward end and an aft end referring to direction of vehicle travel through surrounding waters;

a pump located inside said housing near said aft end and having a rotatable rotor and fixed stator;

at least one water inlet passage formed in said rigid housing forward of said pump for communicating surrounding water to said pump rotor;

a generally cylindrical inner housing containing an electric motor located immediately adjacent and apt of said pump, said motor having a shaft of which said pump rotor is fixed; and at least one water exit passage communicating with said pump stator and running longitudinally along said inner housing past the electric motor and exiting through said rigid cylindrical housing adjacent the aft end thereof for propelling the vehicle.

2. An underwater vehicle in accordance with claim 1 wherein generally cylindrical inner housing is relatively thin walled, whereby water moving along at least one exit passage serves to cool the electric motor located within the inner housing by dissipating heat therefrom.

3. An underwater vehicle in accordance with claim 2 further including:

motor controlled electronics located within said generally cylindrical inner housing aft of said motor, with water moving along at least one exit passage serving to also cool the motor control electronics by dissipating heat therefrom.

4. An underwater vehicle in accordance with claim 1 wherein:

said vehicle has a cylindrical housing approximately six inches in diameter; and wherein said electric motor is a high speed motor operating at greater than 6,000 rpm in order to achieve lower torque loads on the motor shaft for a given amount of motor power in order to thus minimize shaft size and weight.

5. An underwater vehicle in accordance with claim 1 wherein:

there is only one water seal and one bearing on the motor shaft between the electric motor and the pump rotor.

* * * * *

UNITED STATES PATENT AND TRADEMARK OFFICE

CERTIFICATE OF CORRECTION

PATENT NO. : 5,574,246

DATED : Nov. 12, 1996

INVENTOR(S) : Meyers, et al.

It is certified that error appears in the above-identified patent and that said Letters Patent is hereby corrected as shown below:

Col. 5, line 34, delete "apt" insert --aft--.

Signed and Sealed this

Twenty-eighth Day of January, 1997

*Attest:*

Bruce Lehman

BRUCE LEHMAN

*Attesting Officer*

*Commissioner of Patents and Trademarks*